US007090526B2

(12) United States Patent
Monte et al.

(10) Patent No.: US 7,090,526 B2
(45) Date of Patent: Aug. 15, 2006

(54) LEAD-THROUGH TERMINAL

(75) Inventors: Peter Monte, Kestenholz (CH); Alex Rösch, Obergerlafingen (CH); Felix Fuchs, Altbüron (CH)

(73) Assignee: Schaffner EMV AG, Luterbach (CH)

( * ) Notice: Subject to any disclaimer, the term of this patent is extended or adjusted under 35 U.S.C. 154(b) by 0 days.

(21) Appl. No.: 11/068,043

(22) Filed: Mar. 1, 2005

(65) Prior Publication Data

US 2005/0202718 A1 Sep. 15, 2005

Related U.S. Application Data

(63) Continuation of application No. PCT/CH03/00480, filed on Jul. 16, 2003.

(30) Foreign Application Priority Data

Sep. 5, 2002 (CH) ..... 1516/02

(51) Int. Cl.
*H01R 13/627* (2006.01)

(52) U.S. Cl. ..... 439/358; 439/357; 439/552; 439/557

(58) Field of Classification Search ..... 439/557, 439/552, 544, 347, 923, 357–358
See application file for complete search history.

(56) References Cited

U.S. PATENT DOCUMENTS 3,337,836 A * 8/1967 Churla, Jr. ..... 439/295
3,753,212 A * 8/1973 Yamada et al. ..... 439/358
4,453,195 A * 6/1984 Sauer et al. ..... 361/156
4,526,431 A * 7/1985 Kasukawa ..... 439/153
4,619,494 A * 10/1986 Noorily et al. ..... 439/449
4,859,201 A * 8/1989 Marsh ..... 439/290
4,990,094 A * 2/1991 Chandler et al. ..... 439/108
6,328,601 B1 * 12/2001 Yip et al. ..... 439/608
6,714,110 B1 3/2004 Siu ..... 336/96
6,910,911 B1 * 6/2005 Mellott et al. ..... 439/358

FOREIGN PATENT DOCUMENTS

CH 647105 12/1984
DE 1575236 3/1967
DE PA492760 8/1967

(Continued)

OTHER PUBLICATIONS

Feed-through Terminal Block, Phoenix Contact, Model HDFK 4, www.phoenixcobtact.com, Extract From Online Catalog, pp. 1-9, printed Oct. 25, 2005.

(Continued)

*Primary Examiner*—Michael C. Zarroli
(74) *Attorney, Agent, or Firm*—Blank Rome LLP

(57) ABSTRACT

Lead-through terminal with a terminal casing (1) made of insulating material, at least one metallic outer conductor connecting element (3) arranged in the terminal casing (1) or protruding out of the terminal casing (1) and at least one metallic inner conductor connecting element (4) partly arranged in the terminal casing (1) and partly protruding out of the terminal casing (1), connected electrically with said at least one outer conductor connecting element (3). The terminal casing (1) can be fastened elastically in an opening of a housing wall (9) or such from one side only with fastening elements (21) integrated in said terminal casing (1). Thanks to this construction, the lead-through terminal can be fastened for example from outside to the housing wall (9) of an electrical apparatus without it being necessary to provide further fastening means inside the housing.

14 Claims, 4 Drawing Sheets

FOREIGN PATENT DOCUMENTS

| | | |
|---|---|---|
| DE | 2 308 604 | 9/1973 |
| DE | 2929371 (A1) | 12/1984 |
| DE | 3733156 | 11/1988 |
| DE | 19801260 | 1/1998 |
| EP | 1 333 544 A1 | 1/2003 |

OTHER PUBLICATIONS

Molded Feed-through Terminal Block, Phoenix Contact, Model VDFK 4/K, www.phoenixcobtact.com, Extract From Online Catalog, pp. 1-8, printed Oct. 25, 2005.

* cited by examiner

LEAD-THROUGH TERMINAL

REFERENCE DATA

This application is a continuation of International Patent Application PCT/CH03/00480 (WO04023606) filed on Jul. 16, 2003, claiming priority of 2002CH-1516 of Sep. 5, 2002, the contents whereof are hereby incorporated by reference.

FIELD OF THE INVENTION

The present invention concerns a lead-through terminal for leading at least one electric line through a housing wall or such.

DESCRIPTION OF RELATED ART

Lead-through terminals are used mainly for electrical apparatus with housings and serve for leading through one or several lines through the housing wall. Lead-through terminals generally have a terminal casing made of insulating material, at least one metallic outer conductor connecting element arranged in the terminal casing or protruding out of the terminal casing, at least one metallic inner conductor connecting element partly arranged in the terminal casing and partly protruding out of the terminal casing, and connected electrically with said at least one outer conductor connecting element. They are fastened to the housing wall in such a manner, that a body part of the terminal casing with the outer conductor connecting element lies outside the housing whilst a foot part of the terminal casing with the inner conductor connecting element lies inside the housing.

The outer conductor connection, which is accessible from outside the housing, is often made as screw-terminal element, while the inner conductor connecting element, which serves the connection with components of the electrical apparatus inside the housing, is generally made as connection pin-solder terminal, flat pin terminal, wire-wrap terminal. Other embodiments are however also possible.

Various embodiments of lead-through terminals and in particular of fastening means for lead-through terminals are known from the prior art.

Some lead-through terminals are for example fastened to the housing wall of the electrical apparatus with the aid of screws and nuts. Such fastening means however have the disadvantage that each screw requires an additional opening in the housing wall and that the terminal casing must be large enough to offer sufficient space for the screws.

Other lead-through terminals have casings that consist mainly of two main parts. The first part of the terminal casing is partly lead from outside through an opening in the housing wall whilst a second part is lead from inside through the opening and is fastened with the first part. The part lead from outside can for example have a threading, with the inner part being an adapted nut. Other embodiments for connecting both parts of the terminal casing are known, such as for example latches, clips, etc.

All the aforementioned prior art lead-through terminals have the considerable disadvantage that they must be fastened to the housing wall from outside and from inside, which is difficult or even impossible if the space inside the housing is too small.

It is thus an aim of the invention to propose a lead-through terminal that is easy to fasten.

It is a further aim of the invention to propose a lead-through terminal that can be fastened in a stable manner.

BRIEF SUMMARY OF THE INVENTION

These aims are achieved by a lead-through terminal having the characteristics of the first independent claim. Other advantageous embodiments furthermore proceed from the dependent claims and the description.

These aims are achieved in particular through a lead-through terminal with a casing made of insulating material, at least one metallic outer conductor connecting element arranged in the terminal casing or protruding out of the terminal casing, at least one metallic inner conductor connecting element partly arranged in the terminal casing and partly protruding out of the terminal casing, connected electrically with said at least one outer conductor connecting element, with the terminal casing being capable of being fastened elastically in an opening of a housing wall or such from one side only with fastening elements integrated in the terminal casing. Thanks to this arrangement, the lead-through terminal can for example be fastened from outside to the housing wall of an electrical apparatus without it being necessary to provide further fastening means inside the housing.

BRIEF DESCRIPTION OF THE DRAWINGS

The invention will be better understood by reading the description of a preferred embodiment and with the aid of FIGS. 1 to 8, in which.

DETAILED DESCRIPTION OF POSSIBLE EMBODIMENTS OF THE INVENTION

Figure 1:
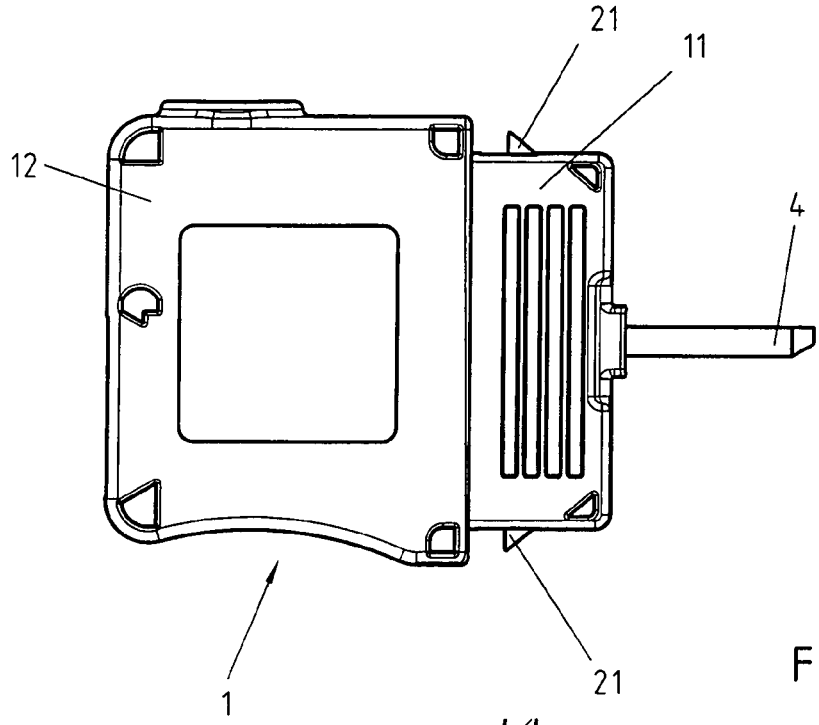
FIG. 1 is a profile view of a lead-through terminal according to a preferred embodiment of the invention.

FIG. 1 illustrates a lead-through terminal according to a preferred embodiment of the invention. All elements of the lead-through terminal are at least partly arranged in a terminal casing 1 made of insulating material. In the head part (which is also referred to as body part) 12 of the terminal casing 1 is an outer conductor connecting element 3 (represented in FIG. 2). An inner conductor connecting element 4 protrudes from the foot area 11. Spring-loaded wedges 21 latch from both sides of the foot area 11 and serve to fasten the lead-through terminal for example to the housing wall of an electrical apparatus.

Figure 2:
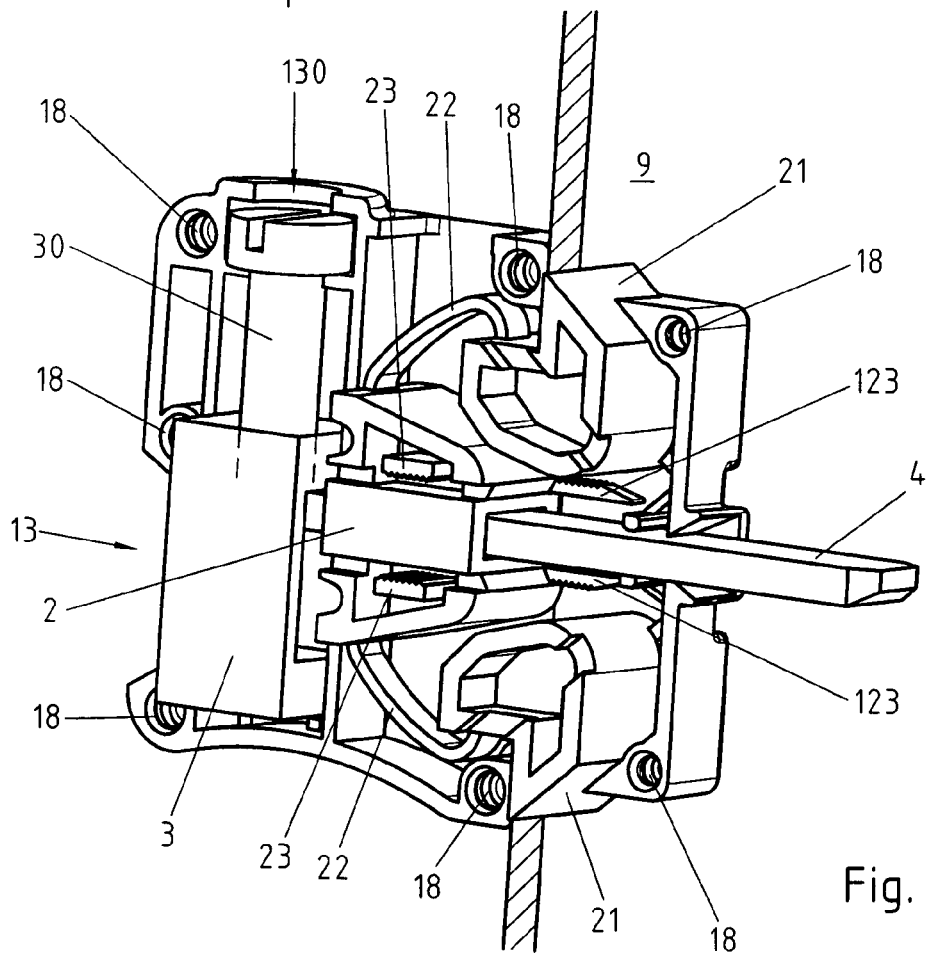
FIG. 2 is a view in perspective of a lead-through terminal according to a preferred embodiment of the invention.

The terminal casing 1 is built of two halves that are held together with snap connections. FIG. 2 shows an open lead-through terminal. On the side of the represented half 10 of the terminal casing 1 are holes 18 that correspond exactly to pins on the other half (not represented) of the terminal casing 1 and that serve the snap connections.

When the lead-through terminal is fastened to the housing wall 9 of an electrical apparatus, the body part 12 with the outer connector element 3 lies essentially completely on the outer side of the housing wall 9, whilst the foot part 11 with the protruding inner conductor connecting element 4 is arranged essentially completely on the inner side of the housing wall 9. Inside the terminal casing, the outer conductor connecting element 3 and the inner conductor connecting element 4 are electrically connected.

The outer conductor connecting element 3 is preferably made as screw-terminal element. The outer conductor connecting element 3 is accessible through an access opening 13 in the terminal casing for the insertion of an electric line (not represented) and through an actuation opening 130 in the terminal casing for the insertion of actuating tools (not represented).

The inner conductor connecting element 4 is preferably made as connection pin. An electric line (not represented) for example can be soldered on the end of the connection pin 4 protruding out of the terminal casing.

Inside the terminal casing, the connection pin 4 extends into the screw-terminal element 3. When the screw 30 of the screw-terminal element 3 is screwed in order to fasten the corresponding line, this line is pressed against the end of the connection pin 4. The electric contact between the connecting elements 3 and 4, resp. between the corresponding lines (not represented), is thus ensured inside the lead-through terminal.

Figure 4:
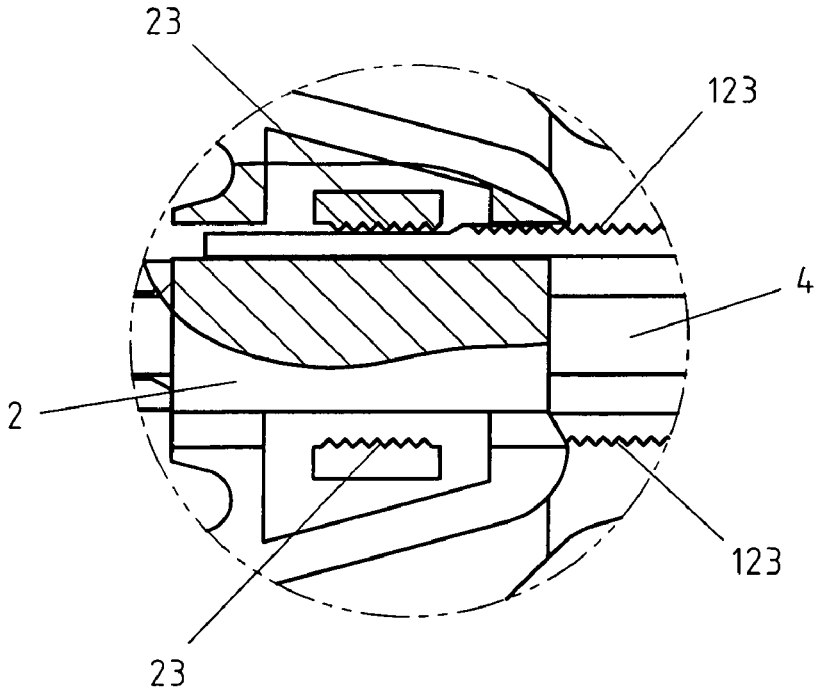
FIG. 4 is a detail of the latchings inside the lead-through terminal.

The fastening elements that serve for fastening the lead-through terminal to the housing wall 9 consist of two wedges 21 that latch partially from the foot area of the terminal casing. The wedges 21 are connected elastically with a locking bar 2 through spring-loaded connecting elements 22. The locking bar 2 comprises the connection pin 4 and is lead on the guiding rails 123 on the inner side of the terminal casing. The opening in the locking bar 2 is chosen large enough so that no heat transmission from the connection pin 4 to the locking bar 2 can occur if for example an electric line (not represented) is soldered on the connection pin 4. On both sides of the locking bar 2 are two latchings 23 that work together with corresponding latchings on the guiding rails 123 and that serve for locking the wedges 21 when the locking bar 2 is moved in the direction of the wedges 21. FIG. 4 shows a detail of these latchings.

Figure 3:
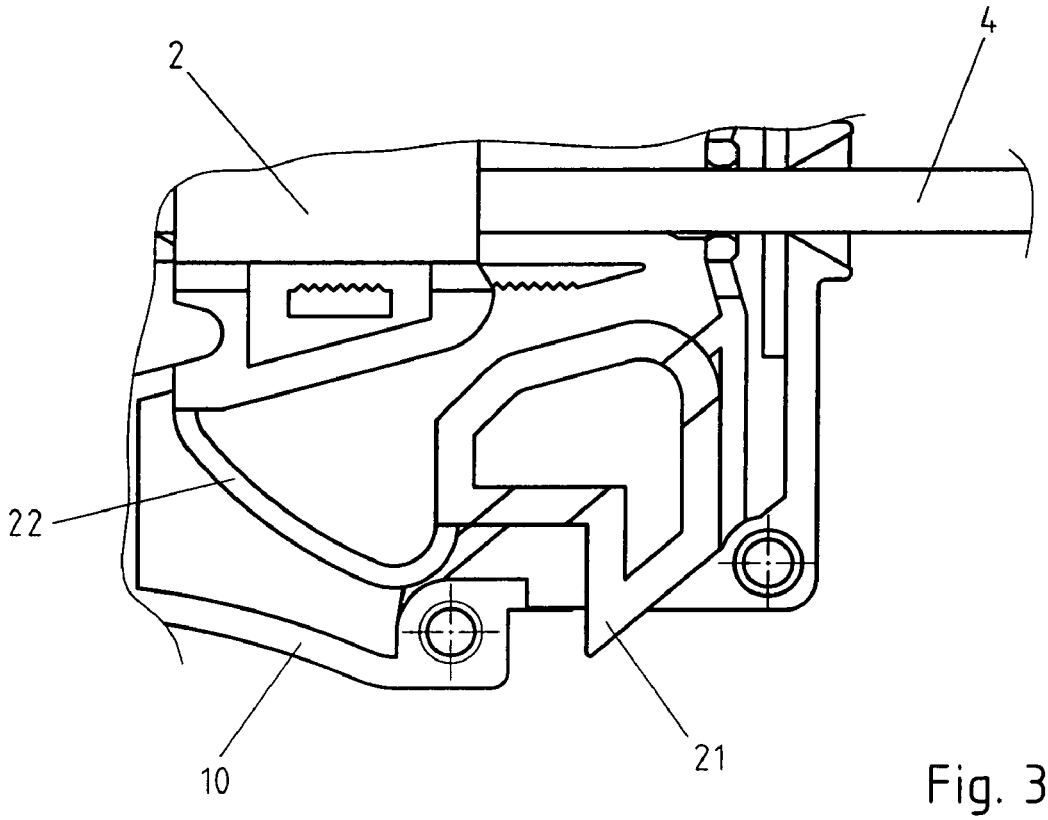
FIG. 3 shows a detail of the fastening elements in the terminal casing.

The lead-through terminal according to the preferred embodiment of the invention is fastened only from one side to the housing wall 9, which represents a considerably advantage over the prior art lead-through terminals, mainly if the inner side of the housing wall 9 is ill accessible. The foot area 11 is inserted through a suitable opening in the housing wall 9 until the head part 12 comes to rest on the housing wall 9. The wedges 21 that are held elastically in the terminal casing 1 (FIG. 3) then spring partially out of the terminal casing 1 and against the inner side of the housing wall 9. The lead-through terminal is then already fastened to the housing wall but not locked.

The lead-through terminal can be locked to the housing wall 9 by exerting pressure on the locking bar 2 from outside through the access opening 13 with a tool, for example with a specific tool, so that it moves in the direction of the wedges 21 along the guiding rail 123. The latchings 23 of the locking bar 2 then work with the corresponding latchings on the guiding rails 123 of the terminal casing. For the locking bar 2 and for the wedges 21, the angle of the surfaces coming into contact are chosen so that they hold self-locked during the locking operation. Thanks to this angle, which is shown in more detail in FIG. 3, the wedges 21 are moved during this locking operation in the direction of the inner side of the housing wall 9. This movement of the wedges 21 allows the same lead-through terminal to be fastened to housings with walls of different thickness.

Figure 5:
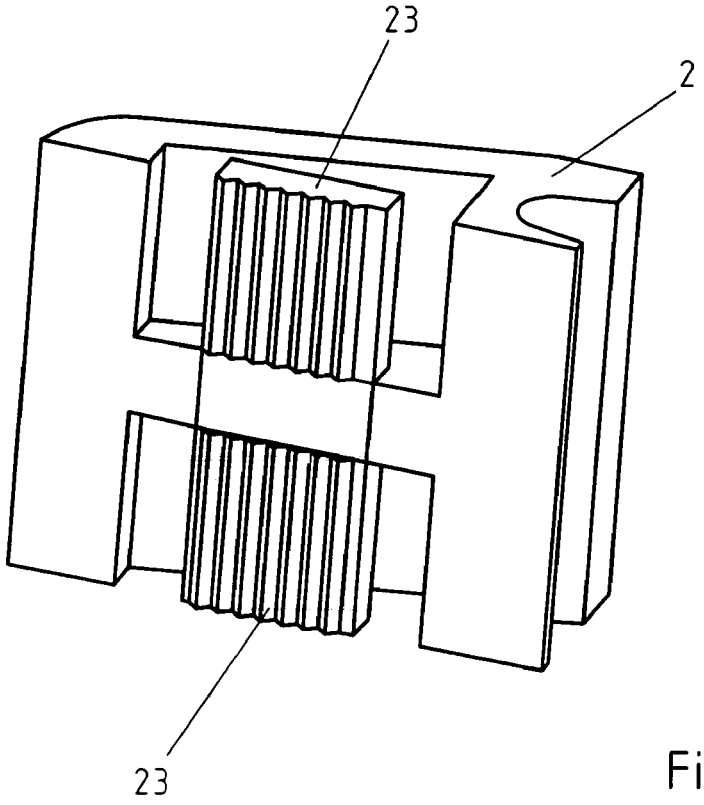
FIG. 5 shows the displacement of the locking bar's latchings.

The steps of the latchings 23 and of the latchings on the guiding rails 123 are preferably to be kept as small as possible, so that the distance between the wedges 21 and the head part 12 can be adjusted as exactly as possible to the thickness of the housing wall 9. In the preferred embodiment of the invention, the angle between the locking bar 2 and the wedges 21 leads to a gearing down of the steps of the latchings 23 and of the latchings on the guiding rails 123. Additionally, the latchings 23 are preferably shifted in pairs by a half-step (FIG. 5). The precision of this adjustment can thus be doubled as compared with the accuracy achieved with the smallest step possible.

The fastening elements 21 are preferably located on the widest side of the foot part. Thanks to this construction, the lever action on the lead-through terminal of a pressure exerted on the terminal casing 1, for example during screwing of an external line in the screw-terminal element 3 with the screw 30, remains very small.

Figure 8:
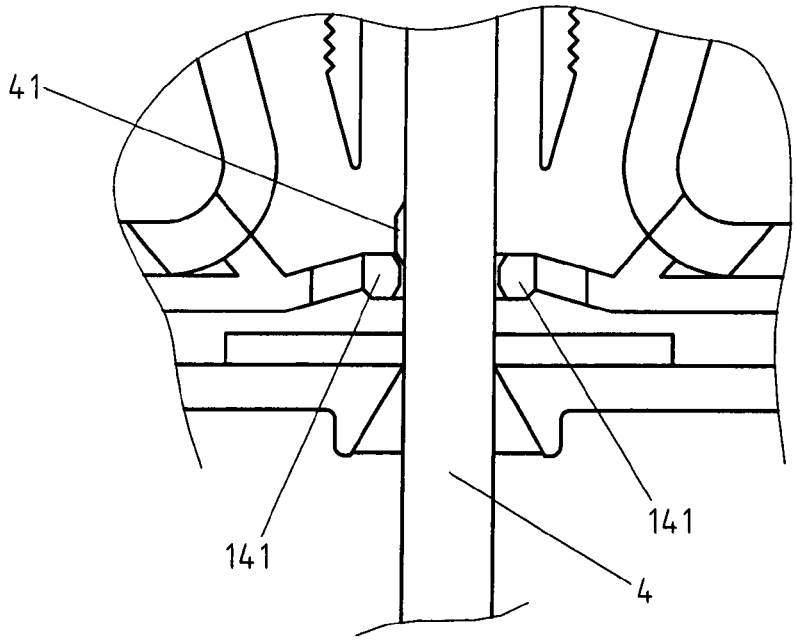
FIG. 8 shows the latching for holding the inner connecting element.

In the lead-through terminal according to the preferred embodiment of the invention, the connection pin 3 is not fastened tightly in the terminal casing as long as it is not locked in the screw-terminal element 3. It therefore has on at least one side a latching 41 that works with pins 141 in the terminal casing (FIG. 8) in order to prevent it from falling out inopportunely of the terminal casing, either during assembly of the lead-through terminal to the housing wall 9 or during transport of the unplugged electrical apparatus.

This construction has the advantage that the connection pin 4 is inserted in the terminal casing 1 only after the lead-through terminal has been fastened to the housing wall 9. Thus for example the corresponding line to the electrical apparatus can be soldered to the connection pin 4 while still outside of the housing and be connected only afterwards with the already mounted lead-through terminal, by inserting the connection pin 4 in the terminal casing 1. The soldering process is thus performed in optimum conditions outside of the housing, in which the available space is often too small. Instead of the connection pin 4, it is possible in certain circumstances to insert a line connection of the electrical apparatus with a suitable shape directly into the terminal casing 1.

Figure 6:
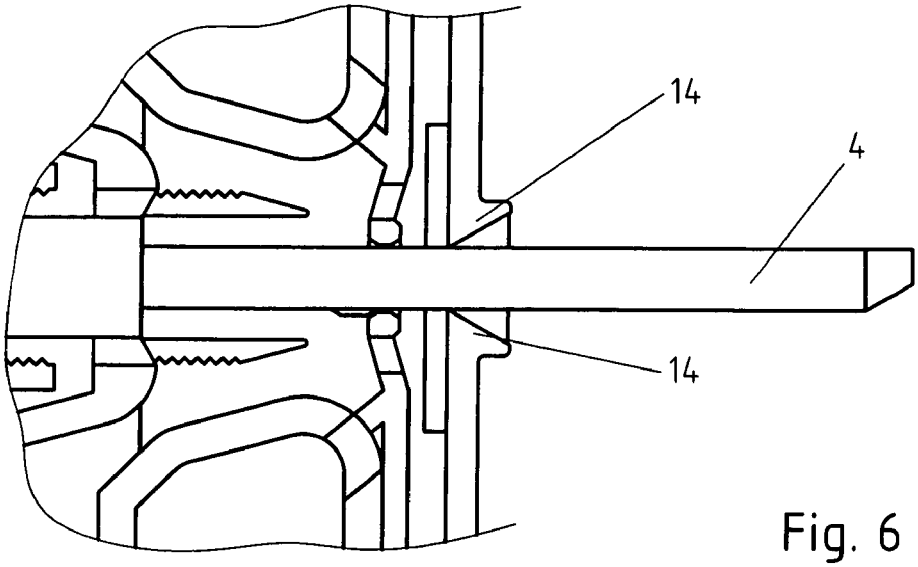
FIG. 6 is a detail of the sealing means of the terminal casing.

After assembly of the electrical apparatus in its housing, the housing is sometimes filled with a casting compound in order to prevent unwanted changes of the elements of the apparatus. This is for example often the case for electrical filters. The lead-through terminal must therefore be tight. This sealing is ensured in the preferred embodiment of the inventive lead-through terminal through lips 14 integrated in the terminal casing 1 around the connection pin 4 (FIG. 6). The distance between the lip 14 is somewhat smaller than the corresponding mass of the connection pin 4. Since the lips next to the connection pin 4 are fine, they are also slightly elastic. They are thus pressed sufficiently against the connection pin 4 to ensure a good sealing of the terminal casing towards the inside of the housing.

The lips 14 additionally serve for lengthening the creepage distance (not represented) between the connection pins of two lead-through terminals possibly fastened next to one another on the same housing wall. Thanks to the lengthening of this electrical creepage distance, the allowed voltage difference between the connection pins of two neighboring lead-through terminals is increased.

Figure 7:
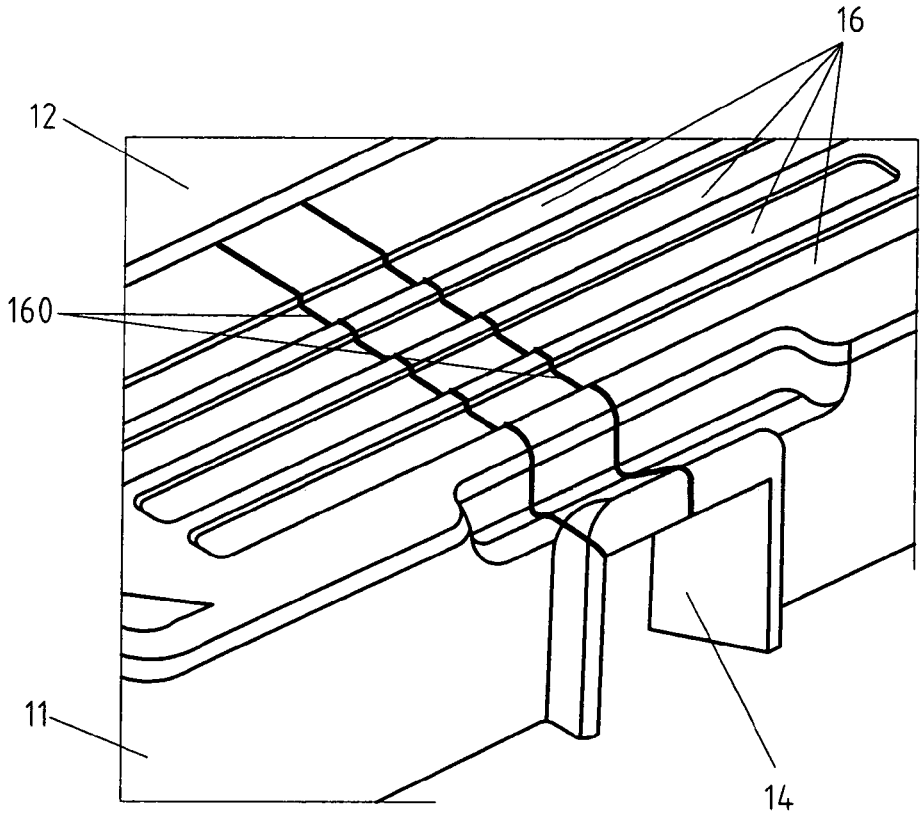
FIG. 7 shows the creepage distance on the foot part of the terminal casing.

FIG. 7 shows a detail of the foot part 11. It can be observed in this figure that the foot part 11 has grooves 16 in the area between the lips 14 and the body part 12. These grooves 16 serve to lengthen the electrical creepage distance 160 between the conducting, preferably metallic connection pin 4 and the possibly also metallic housing wall 9 (not represented in FIG. 7). With these grooves 16, the allowed voltage difference between the connection pin 4 and the housing wall is greater than for a lead-through terminal with the same dimensions but without grooves.

In the preferred embodiment of the invention described here above, the lead-through terminal serves for leading a single electric line. The one skilled in the art will however understand that lead-through terminals with several parallel lines can also be made in the same manner.

In the preferred embodiment of the invention, the fastening elements are located on the foot part of the terminal casing, In which also the inner conductor connecting element is partially arranged. The fastening elements can however also latch from another part of the terminal casing, such as for example from the surface of the head part that comes to rest with the housing wall. This embodiment would however under certain circumstances require additional openings in the housing wall for the fastening elements.

The type of inner and outer conductor connecting elements can also be chosen very differently. In particular, both could in fact be screw-terminal elements.

The invention claimed is:

1. A lead-through terminal comprising a terminal casing made of insulating material, at least one metallic outer conductor connecting element arranged in the terminal casing or protruding out of the terminal casing, at least one metallic inner conductor connecting element partly arranged in the terminal casing and partly protruding out of an opening in the terminal casing, connected electrically with said at least one outer conductor connecting element, with the terminal casing being capable of being fastened elastically from outside the terminal casing via an opening a in housing wall with fastening elements integrated in said terminal casing, with a locking bar being provided for locking said fastening elements, wherein said locking bar can be locked from outside the terminal casing, and wherein said lead-through terminal being fastened to said housing wall through holding said housing wall between said fastening elements and a head part of said terminal casing and the distance between said fastening elements and said head part being adjustable.

2. The lead-through terminal of claim 1, said locking occurring through self-locking between said locking bar and said fastening elements.

3. The lead-through terminal of claim 1, the fastening elements lying on the furthest sides of a foot part of said terminal casing.

4. The lead-through terminal of claim 1, said fastening elements being capable of being adapted to different thicknesses of said housing wall.

5. The lead-through terminal of claim 1, said fastening elements being wedges.

6. The lead-through terminal of claim 5, said wedges latching from said terminal casing.

7. The lead-through terminal of claim 1, said locking bar having latchings.

8. A lead-through terminal comprising a terminal casing made of insulating material, at least one metallic outer conductor connecting element arranged in the terminal casing or protruding out of the terminal easing, at least one metallic inner conductor connecting element partly arranged in the terminal casing and partly protruding out of an opening in the terminal casing, connected electrically with said at least one outer conductor connecting element, with the terminal casing being capable of being fastened elastically from outside the terminal casing via an opening a in housing wall with fastening elements integrated in said terminal casing, with a locking bar being provided for locking said fastening elements, wherein said locking bar can be locked from outside the terminal casing, wherein said inner conductor connecting element being capable of being inserted in said terminal casing after said lead-through terminal has been fastened to said housing wall.

9. The lead-through terminal of claim 8, said inner conductor connecting element being a line connection of an electrical apparatus.

10. A lead-through terminal comprising a terminal casing made of insulating material, at least one metallic outer conductor connecting element arranged in the terminal casing or protruding out of the terminal casing, at least one metallic inner conductor connecting element partly arranged in the terminal casing and partly protruding out of an opening in the terminal casing, connected electrically with said at least one outer conductor connecting element, with the terminal casing being capable of being fastened elastically from outside the terminal casing via an opening a in housing wall with fastening elements integrated in said terminal casing, with a locking bar being provided for locking said fastening elements, wherein said locking bar can be locked from outside the terminal casing, wherein said fastening elements being connected elastically through spring-loaded connecting elements with said locking bar.

11. A lead-through terminal comprising a terminal casing made of insulating material, at least one metallic outer conductor connecting element arranged in the terminal casing or protruding out of the terminal casing, at least one metallic inner conductor connecting element partly arranged in the terminal casing and partly protruding out of an opening in the terminal casing, connected electrically with said at least one outer conductor connecting element, with the terminal casing being capable of being fastened elastically from outside the terminal casing via an opening a in housing wall with fastening elements integrated in said terminal casing, with a locking bar being provided for locking said fastening elements, wherein said locking bar can be locked from outside the terminal casing, wherein said locking bar having latchings that work together with latchings inside the terminal casing.

12. The lead-through terminal of claim 11, said latchings being shifted in pairs by a half step.

13. A lead-through terminal comprising a terminal casing made of insulating material, at least one metallic outer conductor connecting element arranged in the terminal casing or protruding out of the terminal casing, at least one metallic inner conductor connecting element partly arranged in the terminal casing and partly protruding out of an opening in the terminal casing, connected electrically with said at least one outer conductor connecting element, with the terminal casing being capable of being fastened elastically from outside the terminal casing via an opening a in housing wall with fastening elements integrated in said terminal casing, with a locking bar being provided for locking said fastening elements, wherein said locking bar can be locked from outside the terminal casing, wherein lips provided around the opening provided in said terminal casing for said inner conductor connecting element in order to lengthen the creepage distance between said inner conductor connecting element and an inner connector connecting element of a lead-through terminal fastened next to said lead-through terminal.

14. A lead-through terminal comprising a terminal casing made of insulating material, at least one metallic outer conductor connecting element arranged in the terminal casing or protruding out of the terminal casing, at least one metallic inner conductor connecting element partly arranged in the terminal casing and partly protruding out of an opening in the terminal casing, connected electrically with said at least one outer conductor connecting element, with the terminal casing being capable of being fastened elastically from outside the terminal casing via an opening a in housing wall with fastening elements integrated in said terminal casing, with a locking bar being provided for locking said fastening elements, wherein said locking bar can be locked from outside the terminal casing, wherein grooves being provided on said terminal casing in order to lengthen the creepage distance between said inner conductor connecting element and said housing wall.

* * * * *